United States Patent [19]

Szmuk et al.

[11] Patent Number: 4,619,399

[45] Date of Patent: Oct. 28, 1986

[54] MULTI-POCKET ENVELOPE FOR FLOPPY DISCS

[76] Inventors: Szilvia Szmuk, 59 W. 82; J. Paul Kirouac, 200 W. 90 St., both of New York, N.Y. 10024; Betsy Feist, 140 E. 81 St., New York, N.Y. 10028

[21] Appl. No.: 640,013

[22] Filed: Aug. 10, 1984

[51] Int. Cl.[4] ..... B65D 27/08

[52] U.S. Cl. ..... 229/72; 493/245; 493/246; 493/254

[58] Field of Search ..... 229/72, 68 R; 206/309, 206/311, 312; 493/246, 254, 244, 245

[56] References Cited

U.S. PATENT DOCUMENTS

| | | | |
|---|---|---|---|
| 1,060,559 | 4/1913 | Rockwell | 206/312 |
| 1,379,198 | 5/1921 | Markgraf | 229/72 |
| 1,424,840 | 8/1922 | Markgraf | 229/72 |
| 1,453,189 | 4/1923 | Salter | 229/72 |
| 1,464,378 | 8/1923 | Wilburger | 229/72 |
| 2,771,076 | 11/1956 | Peter | 206/312 |
| 2,986,325 | 5/1961 | Loderhose | 206/312 |
| 3,556,391 | 1/1971 | Kosterka | 206/312 |
| 3,717,297 | 2/1973 | Perry | 229/72 |
| 4,313,558 | 2/1982 | Benham . | |
| 4,388,958 | 6/1983 | Dworkin . | |
| 4,396,118 | 8/1983 | Watson . | |
| 4,401,257 | 8/1983 | Benham . | |
| 4,420,112 | 12/1983 | Cline . | |

FOREIGN PATENT DOCUMENTS

| | | | |
|---|---|---|---|
| 1222504 | 1/1960 | France | 229/72 |

*Primary Examiner*—Stephen P. Garbe

*Attorney, Agent, or Firm*—Stiefel, Gross, Kurland & Pavane

[57] ABSTRACT

A multiple pocket envelope for storing a floppy disk, microfiche, photographic negatives and positives, and the like and information related thereto, the envelope being formed from a single sheet (10) susceptible of folding by machine. A sheet (10) suitable for forming the envelope and a method of folding the sheet to form the envelope are also disclosed.

36 Claims, 7 Drawing Figures

MULTI-POCKET ENVELOPE FOR FLOPPY DISCS

TECHNICAL FIELD

This invention pertains to a multiple pocket envelope for storing generally planar articles, such as computer disks and related printed information.

BACKGROUND OF THE INVENTION

Since the advent of the microcomputer and its essential complement the floppy disk, various storage containers have become available, spurred by the need both to protect the fragile disks and to manage the body of information stored thereon. The disks are typically sold in open top envelopes to which a small gummed label can be affixed to identify the contents.

Problems arise, however, because information on the disk can readily be changed, but the labels cannot, and the limited space afforded by the label often cannot accommodate suitable identification of all data stored on the disk. Moreover, the user is warned against storing any other objects, such as printouts of a directory, etc., within the disk envelope, because of the potential harm to the disk through contact with foreign objects.

Numerous attempts have been made to solve the problem of how to store the disks together with identification of the information stored thereon. Such attempts have included a software program which prints out disk labels in a predetermined format, ruled disk envelopes coordinated with the disks for easy matching, hole-punched plastic envelopes for storing and transporting the disks in ring binders, hanging folders fitted with disk sleeve attachments and clear plastic pockets having self-stick backs for affixing to standard disk envelopes. However, none of these solutions has been widely accepted, either because they are not sufficiently versatile or because they are too expensive, or both.

DISCLOSURE OF THE INVENTION

The present invention is a self-contained multiple pocket envelope for the storage and protection of a computer disk and printed information related thereto. The related information may comprise a listing of the contents of the disk, a full test print out of information on the disks, etc. The invention also comprises a method for making the envelope. As will be apparent hereinafter, the envelope of the invention is also suitable for use with other items requiring specialized storage and indexing, such as microfiche, photographic positives and negatives, as well as other planar objects containing information.

The preferred envelope of the invention is formed from a unitary die-cut blank of paper, pressboard, Tyvec, or other suitable material. When folded in accordance with the method disclosed herein, the blank forms three openings or pockets, namely, a front pocket having a side opening dimensioned for easy insertion and removal of an index card, a center pocket having an open top for storing the disk, and a large back opening designed to hold one or more folded sheets of paper such as notes, a disk directory or an annotated catalog of the disk contents.

The preferred envelope is provided with a hole punched edge to enable the user to place the envelope in a ring binder. Alternatively, the hole punched edge may be folded back or trimmed off to afford the user the option of storing the envelope in a standard disk box or similar container.

Although any suitable index card may be stored in the front pocket, a specially designed multifunction card is incorporated in a preferred embodiment. The card is desirably provided with punched holes for placement in a ring binder. If desired, the hole punched edge can be trimmed off. Once trimmed, the card is reduced to standard size whereupon it will fit into a standard card file.

Further features and advantages of the envelope in accordance with the present invention will be more fully apparent from the following detailed description and annexed drawings of the presently preferred embodiment thereof.

BEST MODE FOR CARRYING OUT THE INVENTION

Figure 1:
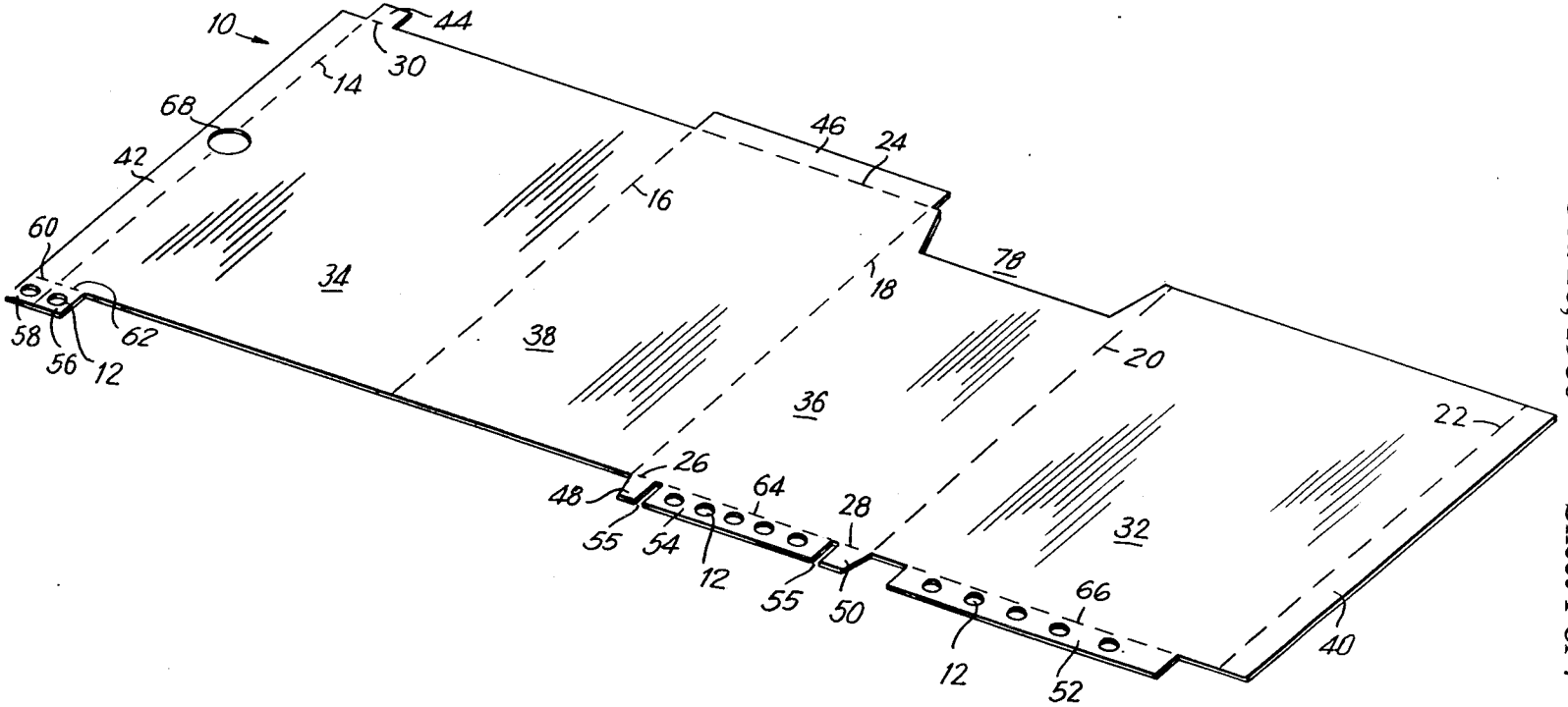
FIG. 1 is a plan view of an elongate die cut blank from which the envelope of the invention may be formed.

Referring now to the drawings, and initially to FIGS. 1–6, 10 designates a blank from which the preferred envelope in accordance with the present invention is formed. The blank 10 is die-cut, preferably from paper, pressboard or Tyvec, although other suitable materials may be used. Tyvec is a duPont trade name.

As shown in FIG. 1, blank 10 is provided with a plurality of fold lines 14, 16, 18, 20, 22, 24, 26, 28, 30, 60, 62, 64 and 66. As will be explained below, it is presently contemplated that the blank 10 will be folded by machine. When this is done, fold lines 14, 16, 18, 20, 22, 24, 26, 28 and 30 need not be scored or otherwise defined. Nevertheless, these fold lines are marked in the drawings to facilitate this description. However, it is preferred that fold lines 60, 62, 64 and 66 be scored or perforated, as it is contemplated that folds about these lines will be accomplished manually, as will be more fully explained below.

Fold lines 16, 18 and 20 divide blank 10 into outer back panel 32, inner back panel 34, outer front panel 36, and inner front panel 38. Still referring to FIG. 1, it can be seen that the panels 32, 34, 36, 38 are not of equal width. Inner back panel 34 is the widest with outer back panel 32 slightly narrower. The panels 38 and 36 are of equal width, but narrower than either panel 32 or 34.

Fold lines 14, 22, 24, 26, 28, 30, 60, 62, 64 and 66 define reinforcement flaps 40, 42, closure tabs 44, 48, 50, 56, 58 and closure flaps 46, 52, 54. As can best be seen in FIG. 1, flap 54 and tabs 48 and 50 extend from one end of panel 36, with flap 54 being disposed between tabs 48 and 50 and separated therefrom by slits 55. Also as shown in FIG. 1, panel 36 is indented at 78 opposite flap 54, the indent being substantially coextensive with the width of the panel. Flaps 52, 54 and tabs 56, 58 are each provided with a multiplicity of punched holes 12. The holes 12 are spaced for placement in a standard ring binder, as will be explained below. A somewhat larger hole 68 is also provided in the blank 10 centered on the fold line 14.

Figure 2:
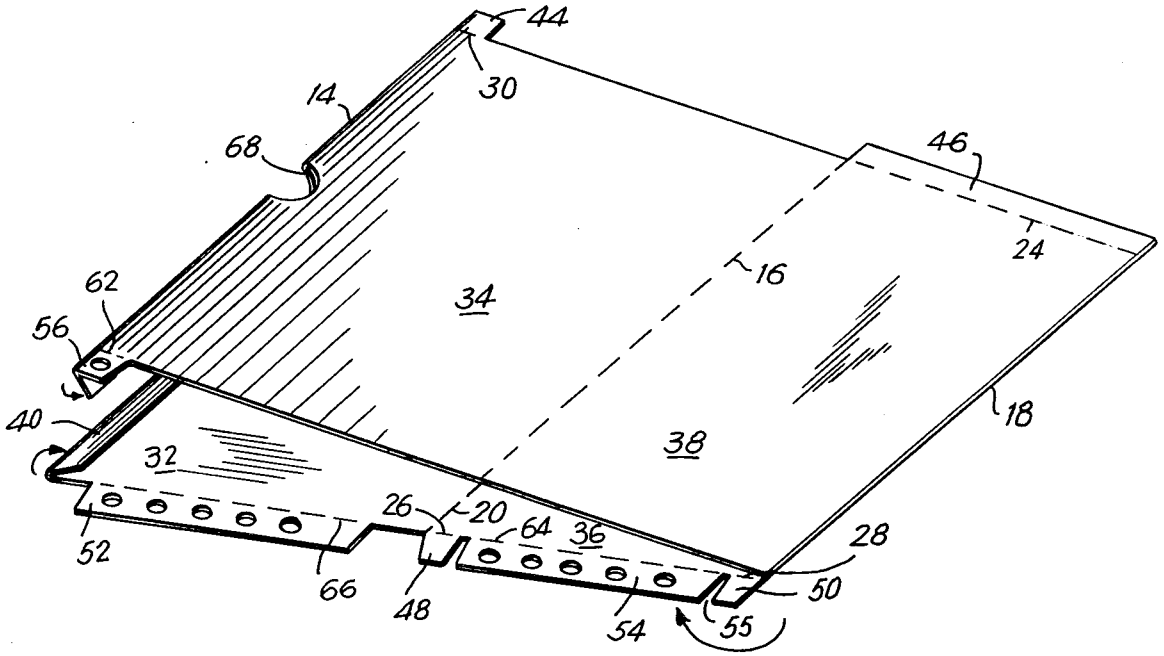
FIG. 2 is a perspective view demonstrating the initial steps of the method of folding the blank of FIG. 1 to form the envelope of the invention.

To form the envelope of the invention from the blank 10, and still referring to FIG. 1, reinforcement flap 40 is folded beneath the panel 32 about the fold line 22. Referring to FIG. 2, blank 10 is next folded about the fold line 18 such that panels 34 and 38 overlie, respectively, panels 32 and 36. In this position fold lines 16 and 20 coincide, with fold line 16 on top.

Figure 3:
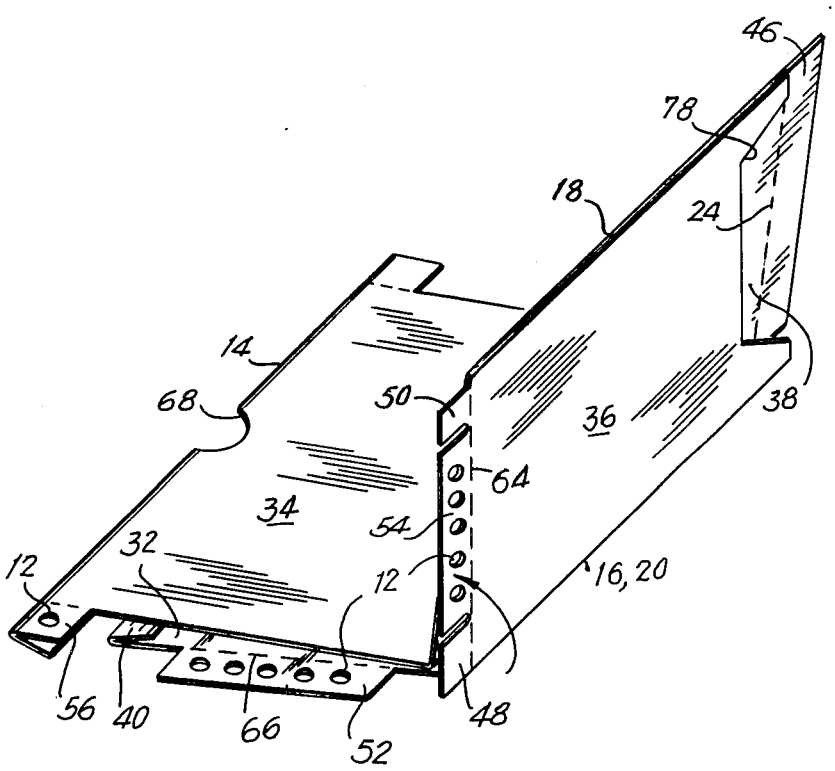
FIG. 3 is a perspective view demonstrating subsequent steps of the method of folding the blank.

As shown in FIG. 3, the blank 10 is next folded about coincidental fold lines 20 and 16 such that panels 36, 38 are folded on top of the panels 32, 34. When this fold is completed, inside back panel 34 and inside front panel 38 confront each other and form the inside of the envelope, with outer back panel 32 and outer front panel 36 forming the outside of the envelope.

Figure 4:
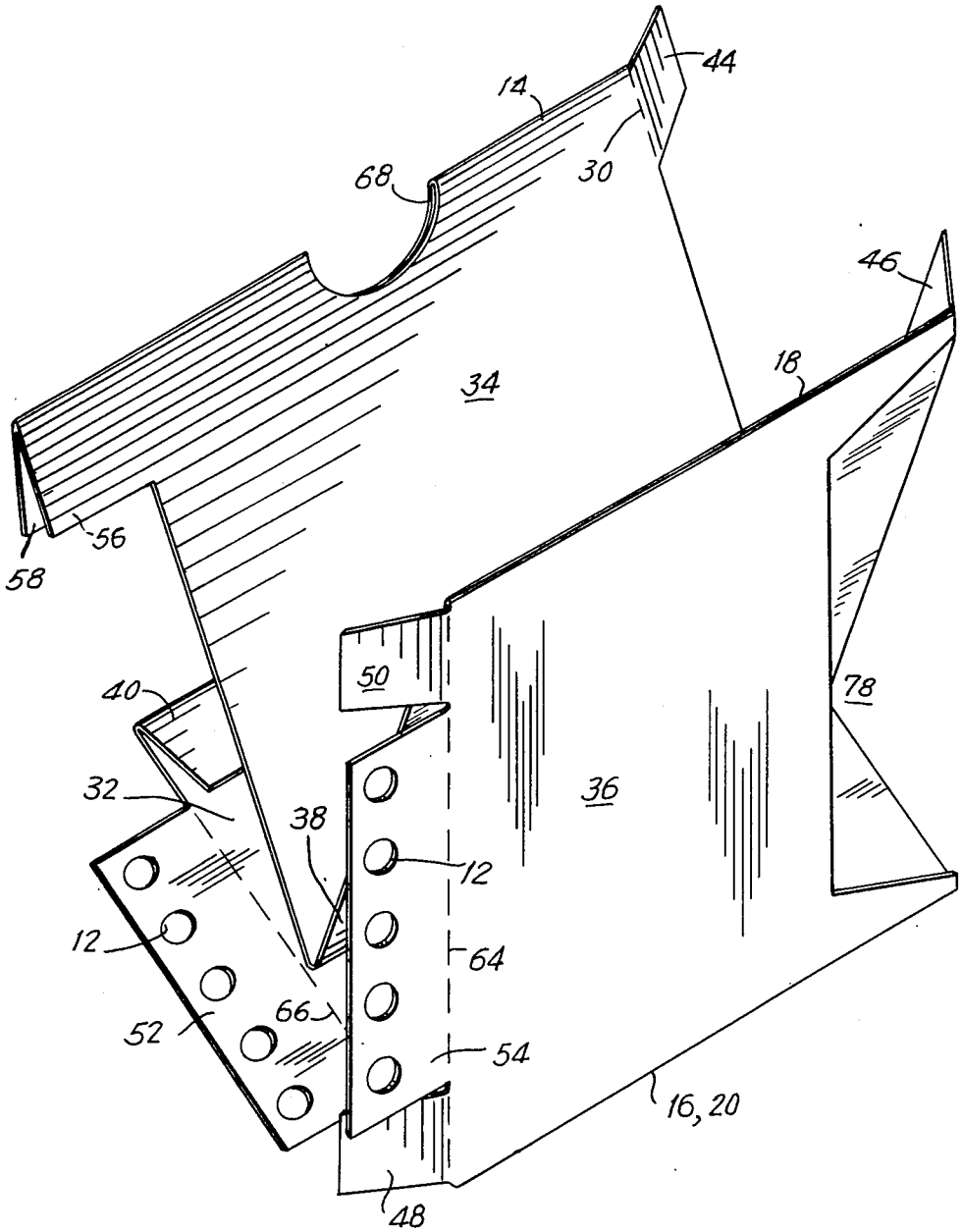
FIG. 4 is a perspective view demonstrating further steps of the method.
Figure 5:
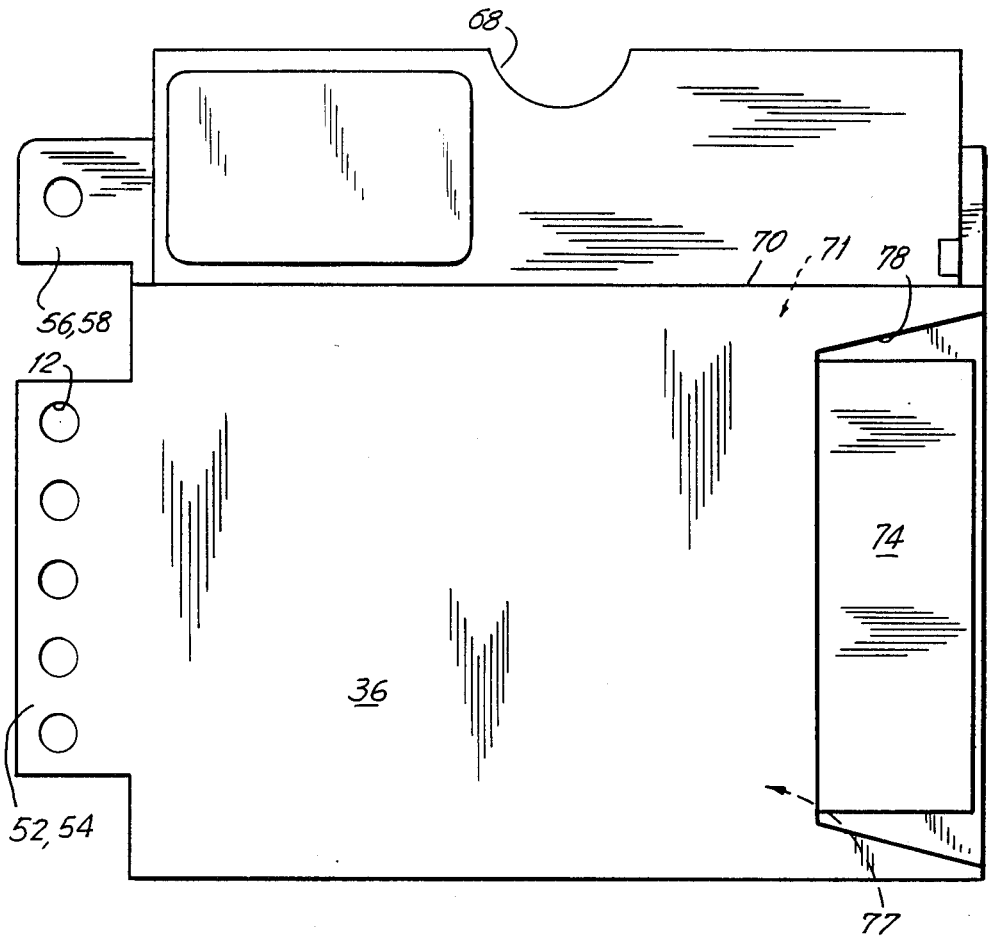
FIG. 5 is a front elevational view of the folded envelope.
Figure 6:
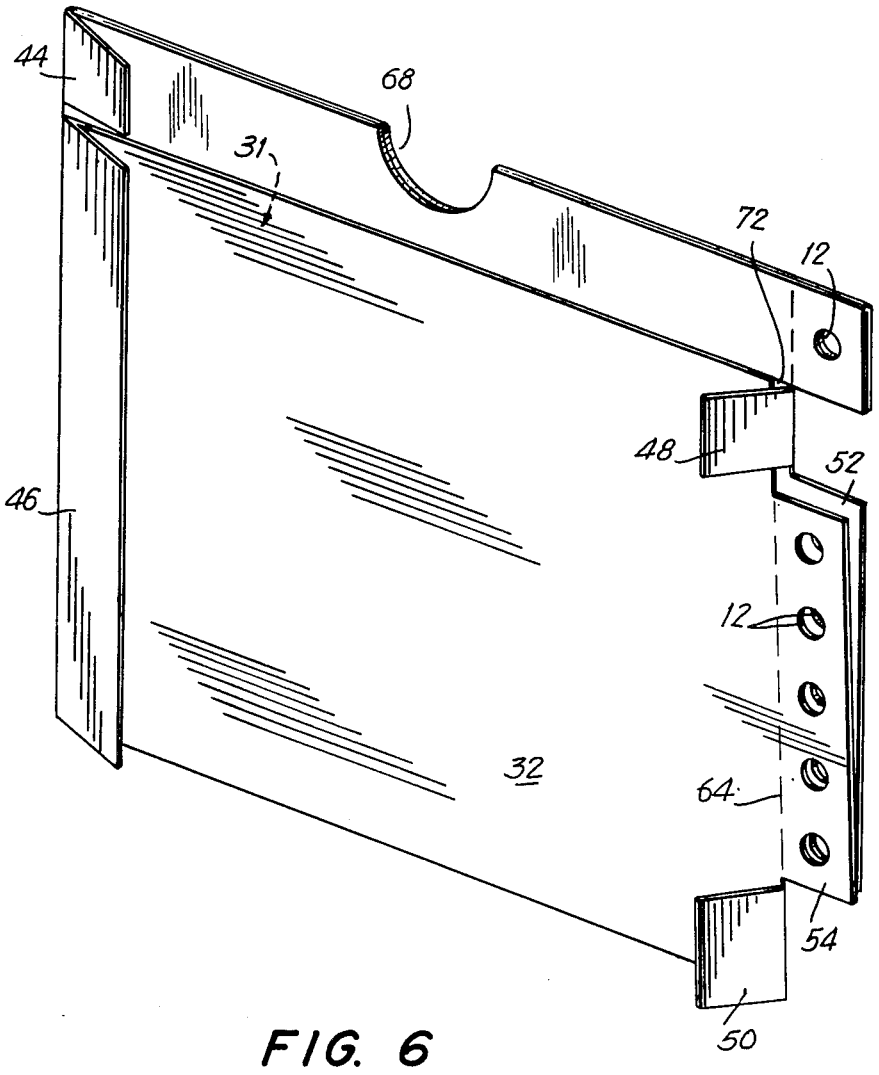
FIG. 6 is a perspective view showing the back of the folded envelope.

Referring now to FIGS. 4–6, closure flap 46 on inside front panel 38 is now folded back and attached by suitable means, such as tape or glue, to one end of the outside surface of back panel 32 and tabs 48 and 50 on front panel 36 are folded back and attached to the outside surface of the panel on the opposite end. The hole punched flap 52 on the back panel 32 is then attached to the hole punched flap 54 on the outer front panel 36. It will be appreciated that attachment of the flap 46 and tabs 48, 50 to the back panel 32 and joinder of the flaps 52, 54 serve to hold the folded envelope in assembled relation.

Reinforcement flap 42 now is folded beneath panel 34 about the fold line 14. To hold flap 42 adjacent panel 34, closure tab 44 is now folded back and attached to the reinforcement flap 42 (FIG. 4) and the hole punched tabs 56, 58 are then attached together. It will be appreciated that the placement of the hole 68 on the fold line 14 yields a semi-circular notch (FIG. 2) upon folding of the flap 42 beneath panel 34. The notch permits easy retrieval of the disk stored in the center pocket of the envelope, as will be more fully explained hereinafter.

If desired, a suitable adhesive may be preapplied to the tabs 44, 48, 50, 56, 58 and flaps 46, 52, 54 before the blank 10 is folded. This would be especially desirable when, as is preferred, the blank 10 is machine folded. Even when manual folding is employed, it may be desirable to preapply an adhesive, for example of the type which becomes sticky when wetted.

If the blank 10 is machine folded, the folding sequence will vary somewhat from the foregoing description. When machine folding, it is contemplated that the reinforcement flaps 40, 42 will be folded simultaneously with the folding of blank 10 about line 18. The blank would then be folded about coincident fold lines 20 and 16, after which the closure tabs and flaps would be folded and secured to retain the envelope in assembled relation.

Referring now to the completed envelope, and as shown in FIG. 5 which depicts a front view thereof, a front pocket 77 is formed between the inner and outer front panels 36, 38. The panels 36, 38 are joined along their respective left hand edges as seen in FIG. 5 by closure tabs 48, 50 and joined flaps 52, 54. The top edges of the panels 36, 38 are integrally joined along common line 18. The bottom of the pocket is closed by the integral surface between panels 36, 32 in the vicinity of fold line 20 which extends beneath the bottom edge of panel 38. The right hand edges of the panels 36, 38 are not closed thereby defining an opening communicating with pocket 77. The opening is dimensioned to accommodate insertion of a card, such as a standard 3"×5" index card, into the pocket 77. As shown, indent 78 in panel 36 results in a portion of the card 74 being exposed. This facilitates access to the card and allows immediate viewing of any information written or printed on the exposed portion without withdrawing the card from pocket.

Still referring to FIG. 5, a center pocket 71 is formed between inner back panel 34 and inner front panel 38. The panels 34 and 38 are joined along their bottom edges at common fold line 16. The right hand edges of the flaps 34, 38 are joined by the flap 46, while the left hand edges of these panels are joined by the tabs 48, 50 and joined flaps 52, 54. The confronting upper edges of the panels 34 and 38 are not joined thereby defining a top opening 70 communicating with the pocket 71. The center pocket 71 is intended for storage of the disk. As described above, the panel 34 is the widest of the four panels. Consequently, and as shown in FIG. 5, when the envelope is assembled the top of the panel 34, incoporating the notch 68, extends above the other panels. The dimension of the panel 34 is selected such that when the disk is fully received in center pocket 71, the top edge of the disk extends slightly above the notch 68. As a result, the top of the disk is exposed such that a user can readily determine whether or not the envelope contains a disk without looking inside the pocket 71. Also, any information on the label 80 on the exposed portion of the disk can be readily viewed without withdrawing the disk. The exposed portion of the disk remains protected by the panel 34, which, in the vicinity of the exposed disk, is provided with reinforcing flap 42 for enhanced cushioning and support. The notch 68 permits the top edge of the disk to be readily grasped by a user for removing the disk from the center pocket 71.

Referring to FIG. 6, which depicts a back view of the preferred envelope, a rear pocket 31 is formed between outer back panel 32 and inner back panel 34. The pocket 31 is closed on the bottom and both sides. The bottom is closed by the common fold line 20 between panels 32 and 36. The left hand edge of the pocket as seen in FIG. 6 is closed by flap 46 as described above, and the right hand edge is closed by the joined flaps 52, 54 and tabs 48, 50, also as described above. The top edges of the panels 32, 34 are not joined thereby defining a top opening 72. The rear pocket 31 is intended for storing such items as printouts of summary information or contents of the data contained on the disk, notes, instructions or other folded sheets of paper.

As described above, and referring to FIGS. 5 and 6, the preferred envelope includes hole-punched extensions comprising joined flaps 52, 54 and joined tabs 56, 58. This permits the envelope to be stored in a ring binder. Alternatively, these hole-punched flaps 52, 54 and tabs 56, 58 may be folded back, respectively, about coincident fold lines 64, 66 and 60, 62, which fold lines are scored for this purpose. Once folded back, the flaps 52, 54 and tabs 56, 58 may be attached to panel 32 and flap 42, respectively. Alternatively, the hole-punched extensions may be trimmed off. In either event, the resulting envelope structure can be stored in a standard disk file.

An advantage of the envelope according to the invention is that it provides a means of storing and protecting disks as well as means for indexing the information stored thereon, by providing multiple pockets to hold the named articles. Further, using the envelope of the invention affords both easy retrieval of the disk and an index or summary printout of the data contained on the disk.

Another important advantage is the additional protection for the disk afforded by cushioning from the multi-layered envelope. Further cushioning is provided for the disk stored in the center pocket from the cards and folded papers which may be housed in the front and rear pockets, respectively.

Figure 7:
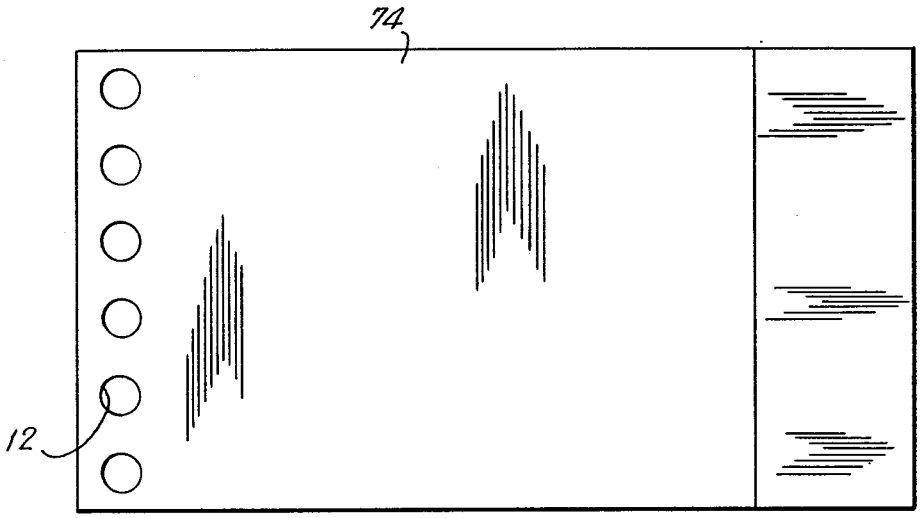
FIG. 7 is a front elevational view of a preferred index card for use with the envelope of the present invention.

FIG. 7 depicts a card 74 designed for storage in the front pocket 77 of the invention. As previously explained, the right side opening 79 of front pocket 77 is dimensioned to receive the card 74. The preferred card, as shown, is provided with a plurality of punched holes 12 along its left hand edge in FIG. 7. These holes are spaced to accommodate placement of the card in a conventional ring binder. For example, a plurality of partially overlapping cards 74 may be placed in a ring binder, with the corresponding envelopes beneath the cards. The non-overlapped or exposed portion of each card could then be imprinted with an identification number, which would also appear on the envelope, with the cards and envelopes arranged in numbered sequence. In this way, the index cards can be rapidly thumbed in the ring binder to locate a particular disk, whereupon the envelope containing that disk may be quickly retrieved by matching the identifying number on the index card with the same number on the corresponding envelope. Alternative methods of arranging the index cards and envelopes in a ring binder are also possible, and will be apparent to those of ordinary skill in the art once this description is known. As a further aid to organization, the same identifying number could be imprinted on the label 80 on the disk and on the notes or other materials stored in rear pocket 81. Alternatively, the hole punched edge of card 74 may be trimmed off, thereby reducing the card to standard size for storage in a file box.

It will be apparent from the foregoing description that the present invention provides an effective and versatile envelope for storing computer disks and information relating to them. The use of three pockets permit a wealth of information to be stored in a single, compact envelope along with the disk itself. The hole punched extensions along one edge of the envelope permit the envelope to be stored in a ring binder. Alternatively, these extensions can be folded back or trimmed off whereupon the envelope will fit in a standard size computer disk file box. A specially designed index card having punched holes along one edge may be used in conjunction with the envelope such that the card may be either retained in the front pocket or separately stored in a ring binder or index box. When the card is retained in the front pocket, the indent in the front surface of the pocket exposes a portion of the card for quickly referencing information imprinted thereon without withdrawing the card. Similarly, the front of the center pocket is lower than the back, such that the top of the disk is exposed whereby information imprinted on the exposed portion may be read without withdrawing the disk. Also, because the disk is stored in the center pocket, it is protected on both sides by multiple layers, thereby providing additional cushioning. This cushioning is in fact enhanced during storage, as typically there is an index card in the front pocket and notes or other materials in the back pocket. Furthermore, because the front and back pockets are separate from the center pocket, there is no need to store materials in the disk pocket, which can result in damage to the disk.

Apart from being highly useful and versatile for its intended purpose, the envelope of the invention is formed from a single die cut blank sheet ideally suited for automated manufacturing processes. In accordance with automated techniques now in use, machine folding of the envelope may include cutting off selected folded edges of the folded sheet 10, such as the folded edge defined by coincident fold lines 16, 20 (FIG. 4), then joining the edges together by an adhesive. It should therefore be understood that any reference herein to an envelope formed from a single sheet is intended to cover envelopes formed in this manner.

While a preferred embodiment of the invention has been described and illustrated, it will be apparent to those of ordinary skill in the art that various changes and modifications may be made therein without departing from the spirit and scope of the invention. For example, the outer front and back panels 36 and 32 may be constructed of a transparent material to accommodate viewing of the contents of the materials in the front and back pockets 77 and 81. Also, the front and back outside panels may be ruled to provide additional space for writing or imprinting pertinent information. Furthermore, the configuration of the openings to the pockets may be varied from that illustrated in the drawings.

Furthermore, while a particular folding sequence has been described for assembling the envelope from the die cut blank, once this description is known it will be apparent to those of ordinary skill in the art that other sequences are also possible. Still other changes in the construction and method of folding the envelope of the present invention will suggest themselves to the person of ordinary skill in the art once this description is known. Accordingly, the above description should be construed as illustrative, and not in a limiting sense, the scope of the invention being defined by the following claims.

We claim:

1. A multipocket envelope having a pocket for storing a substantially planar article, such as a floppy disk, and additional pockets for storing information pertaining to said planar article, said envelope being formed from a one piece elongate sheet having a pair of ends defining therebetween a long dimension of said sheet, said sheet defining four panels, an outer back panel at one end of said sheet, an inner back panel at the other end of said sheet, and outer and inner front panels therebetween, each of said four panels having two opposed sides and two opposed free ends, said free ends being substantially parallel to the long dimension of said sheet; said outer and inner back panels each having one free side coinciding with the ends of said sheet, one side of said outer and inner front panels being joined together along a first fold line substantially perpendicular to the long dimension of said sheet, the other side of said inner front panel being joined to said inner back panel along a second fold line perpendicular to said long dimension of said sheet, and the other side of said outer front panel being joined to said outer back panel along a third fold line perpendicular to said long dimension of said sheet, said panels being arranged in confronting parallel relation in said envelope for defining a front pocket between said inner and outer front panels, a center pocket between said inner front panel and inner back panel, and a rear pocket between said inner and outer panels, and means for at least partially closing said pockets.

2. The envelope of claim 1, wherein said elongate sheet further comprises a first extension on one end of said inner front panel and a second extension on the opposite end of said outer front panel, said extensions being foldable relative to their respective panels into confronting relation with said outer back panel when said panels are in confronting parallel relation in said envelope; and wherein said means for closing said pockets along part of their peripheries comprises means for joining said extensions to said outer back panel.

3. The envelope of claim 2, wherein said sheet further comprises a pair of apertured extensions, one on a free end of said outer front panel and one on the same end of said outer back panel, said apertured extensions being in confronting relation with their apertures aligned when said panels are in confronting relation in said envelope; and means for joining said apertured extensions together.

4. The envelope of claim 3, and further comprising a card insertable in one of said pockets, said card having apertures at one end thereof whereby said envelope and said card may be separately secured in a ring binder.

5. The envelope fo claim 3 wherein said sheet further comprises a second extension on a free end of said outer front panel, said second extension and said apertured extension being on the same end of said outer front panel, and wherein said second extension comprises a pair of tabs and said apertured extension comprises a flap therebetween.

6. The envelope of claim 5, wherein said elongate sheet further defines a first reinforcement flap on the free side of said inner back panel and a second reinforcement flap on the free side of said outer back panel, each reinforcement flap having an opposed pair of free ends, said flaps being folded into confronting relation with their respective panels when said panels are in confronting relation in said envelope; an extension on one end of said inner back panel, said extension being folded into confronting relation with said first reinforcement flap when said panels are in confronting relation in said envelope; and means for securing said extension on said inner back panel to said first reinforcement flap.

7. The envelope of claim 6, wherein said inner back panel is wider than said other panels, said outer back panel is wider than said inner and outer front panels, and said inner and outer front panels are of substantially equal width.

8. The envelope according to claim 7, wherein a hole is provided substantially centered on the line joining the first reinforcement flap to the inner back panel, said hole defining a semi-circular notch when said reinforcement flap is folded into confronting relation with said inner back panel for facilitating withdrawal of an item stored in said center pocket defined between said inner front and inner back panels.

9. The envelope of claim 8, wherein said outer front panel has an indent on one end, said indent being substantially coextensive with the width of said panel,. and wherein said means for closing said pockets comprises means for closing the front pocket along three edges thereof whereby an opening at said one end is defined.

10. The envelope of claim 1, wherein said elongate sheet further comprises a first reinforcement flap on the free side of said inner back panel and a second reinforcement flap on the free side of said outer back panel, each reinforcement flap having an opposed pair of free ends, said flaps being folded into confronting relation with their respective panels when said panels are in confronting relation in said envelope; an extension on one end of said inner back panel, said extension being folded into confronting relation with said first reinforcement flap when said panels are in confronting relation in said envelope; and means for securing said extension on said inner back panel to said first reinforcement flap.

11. The envelope according to claim 10, wherein said inner back panel is wider than said other panels, and including a hole substantially centered on the line joining the first reinforcement flap to the inner back panel, said hole defining a semi-circular notch when said reinforcement flap is folded into confronting relation with said inner back panel for facilitating withdrawal of an item stored in said center pocket defined between said inner front and inner back panels.

12. The envelope of claim 10, further comprising an apertured tab extending from one free end of said inner back panel and another apertured tab extending from the same end of said first reinforcement flap, said tabs being disposed in confronting relation with their apertures aligned when said first reinforcement flap is folded into confronting relation with said inner back panel; and means for joining said tabs together.

13. The envelope of claim 1, wherein said sheet further comprises a pair of apertured extensions, one on a free end of said outer front panel and one on the same end of said outer back panel, said apertured extensions being in confronting relation with their apertures aligned when said panels are in confronting relation in said envelope; and means for joining said apertured extensions together.

14. The envelope of claim 13, and further comprising a card insertable in one of said pockets, said card having apertures at one end thereof whereby said envelope and said card may be separately secured in a ring binder.

15. The envelope of claim 9, further comprising an apertured tab extending from one end of said inner back panel and another apertured tab extending from the same end of said first reinforcement flap, said tabs being disposed in confronting relation with their apertures aligned when said first reinforcement flap is folded into confronting relation with said inner back panel; and means for joining said tabs together.

16. The envelope of claim 15, wherein said means for closing said pockets comprises means for closing the pockets along three edges thereof whereby top openings for said center and rear pockets are defined.

17. The envelope of claim 1, wherein said outer front panel has an indent on one end, said indent being substantially coextensive with the width of said panel, and wherein said means for closing said pockets comprises means for closing the front pocket along three edges thereof whereby an opening at said one end is defined.

18. The envelope of claim 1, wherein said inner back panel is wider than said other panels, said outer back panel is wider than said inner and outer front panels, and said inner and outer front panels are of substantially equal width.

19. The envelope of claim 1, wherein said means for closing said pockets comprises means for closing the pockets along three edges thereof whereby an opening at one end of said front pocket and top openings for said center and rear pockets are defined.

20. A one piece elongate sheet for the formation of an envelope having a pocket for a substantially planar article, such as a floppy disk, and additional pockets for storing information pertaining to said planar article, said sheet comprising: a pair of ends defining therebetween a long dimension of said sheet; an outer back panel at one end of said sheet; an inner back panel at the other end of said sheet; and outer and inner front panels therebetween, each panel having two opposed sides and two opposed free ends; said inner and outer back panels each having one free side coinciding with the ends of said sheet, one side of said outer and inner front panels being integrally hinged along a first fold line substantially perpendicular to the long dimension of said sheet, the other side of said inner front panel being integrally hinged to said inner back panel along a second fold line perpendicular to said long dimension of said sheet, and the other side of said outer front panel being integrally hinged to said outer back panel along a third fold line perpendicular to said long dimension of said sheet; a first extension integrally hinged on one end of said inner front panel; and a second extension integrally hinged on the opposite end of said outer front panel; a first reinforcement flap on the free side of said inner back panel; a second reinforcement flap on the free side of said outer back panel, said reinforcement flaps each having two opposed free ends; and a third extension on one end of said inner back panel, whereby said sheet is foldable along said fold lines for arranging said panels in confronting parallel relation for defining an envelope having a front pocket between said inner and outer front panels, a center pocket between said inner panel and inner back panel, a rear pocket between said inner and outer back panels, said reinforcement flaps are foldable into confronting relation with their respective panels, said third extension is foldable into confronting relation with said first reinforcement flap when said panels are in confronting relation in said envelope, and said first and second extensions are foldable into confronting relation with said outer back panel for retaining the envelope in assembled relation.

21. The elongate sheet of claim 20, wherein said inner back panel is wider than said other panels, said outer back panel is wider than said inner and outer front panels, and said inner and outer front panels are of substantially equal width.

22. The elongate sheet of claim 20, further comprising means for securing said extension on said inner back panel to said first reinforcement flap.

23. The elongate sheet of claim 20, wherein a hole is provided substantially centered on the line joining the first reinforcement flap to the inner back panel, the hole defining a semicircular notch when the reinforcement flap is folded into confronting relation with the inner back panel for facilitating withdrawal of an item stored in said center pocket defined between said inner front and inner back panels.

24. The elongate sheet of claim 20, further comprising an apertured tab extending from one end of said inner back panel and another apertured tab extending from the same end of said first reinforcement flap, whereby said tabs are disposed in confronting relation with their apertures aligned when said first reinforcement flap is folded into confronting relation with said inner back panel.

25. The elongate sheet of claim 24, and further comprising means for joining said tabs together.

26. The elongate sheet of claim 20, further comprising a pair of apertured extensions, one on the end of said outer front panel and one on the same end of said outer back panel whereby said apertured extensions are in confronting relation with their apertures aligned when said panels are in confronting relation in said envelope.

27. The elongate sheet of claim 26, and further comprising means for joining said apertured extensions together.

28. The elongate sheet of claim 26, wherein said second extension and said apertured extension on said outer front panel are on the same end thereof, and wherein said second extension comprises a pair of tabs and said apertured extension comprises a flap therebetween.

29. The elongate sheet of claim 20, wherein said elongate sheet further comprises means for joining said first and second extensions to said outer back panel.

30. The elongate sheet of claim 20, wherein said outer front panel has an indent on one end, said indent being substantially coextensive with the width of said panel.

31. A method of forming a multiple pocket envelope having a pocket for storing a substantially planar article, such as a floppy disk, and additional pockets for storing additional information pertaining to said planar article, said envelope being formed from a one-piece elongate sheet having a pair of ends defining therebetween a long dimension of said sheet; said sheet defining four panels, an outer back panel at one end of said sheet, an inner back panel at the other end of said sheet, and outer and inner front panels of substantially equal width therebetween, each of said four panels having two opposed sides and two opposed free ends; said inner and outer back panels each having one free side coinciding with the ends of said sheet, one side of said outer and inner front panels being joined together along a first fold line substantially perpendicular to the long dimension of said sheet, the other side of said inner front panel being joined to said inner back panel along a second fold line perpendicular to said long dimension of said sheet, and the other side of said outer front panel being joined to said outer back panel along a third fold line perpendicular to said long dimension of said sheet, a first extension on one end of said inner front panel, and a second extension on the opposite end of said outer front panel, said method comprising the steps of folding said sheet about said first fold line for folding said outside front panel into overlying relation with said inner front panel and said outer back panel into overlying relation with said inner back panel with said second and third fold lines coincident; folding said sheet about said coincident second and third fold lines for folding said panels into confronting parallel relation for defining a front pocket between said inner and outer front panels, a center pocket between said inner front panel and inner back panel, and a rear pocket between said inner and outer back panels; folding said extensions relative to their respective panels into confronting relation with said outer back panel; and joining said extensions to said outer back panel.

32. The method of claim 31, wherein said sheet further comprises a first reinforcement flap on the free side of said inner back panel, a second reinforcement flap on the free side of said outer back panel, said reinforcement flaps each having two opposed free ends, and an extension on one end of said inner back panel, and wherein said method further comprises the steps of folding and securing said reinforcement flaps into confronting relation with their respective panels, thereafter folding said extension on said one end of said inner back panel into confronting relation with said first reinforcement flap.

33. The method claim of claim 32, wherein said sheet further comprises an apertured tab extending from one end of said inner back panel and another apertured tab extending from the same end of said first reinforcement flap, and wherein said method further comprises the step of joining said tabs together.

34. The method of claim 33, wherein said sheet further comprises an apertured tab extending from one end of said inner back panel and another apertured tab extending from the same end of said first reinforcement flap, and wherein said method further comprises the step of joining said tabs together.

35. The method of claim 31, wherein said sheet further comprises a pair of apertured extensions, one on the end of said outer front panel and one on the same end of said outer back panel, and wherein said method further comprises the step of joining said apertured extensions together.

36. The method of claim 31, wherein said sheet further comprises an apertured tab extending from one end of said inner back panel and another apertured tab extending from the same end of said first reinforcement flap, and wherein said method further comprises the step of joining said tabs together.

* * * * *